US008104549B2

(12) United States Patent
Lee

(10) Patent No.: US 8,104,549 B2
(45) Date of Patent: Jan. 31, 2012

(54) ACTIVATING DEVICE FOR A DOWNHOLE TOOL

(76) Inventor: Paul Bernard Lee, Calgary (CA)

( * ) Notice: Subject to any disclaimer, the term of this patent is extended or adjusted under 35 U.S.C. 154(b) by 0 days.

(21) Appl. No.: 12/441,939

(22) PCT Filed: Oct. 18, 2007

(86) PCT No.: PCT/IB2007/003117

§ 371 (c)(1),
(2), (4) Date: Mar. 19, 2009

(87) PCT Pub. No.: WO2008/047218

PCT Pub. Date: Apr. 24, 2008

(65) Prior Publication Data

US 2009/0277689 A1 Nov. 12, 2009

(30) Foreign Application Priority Data

Oct. 21, 2006 (GB) ..... 0621007.4
Jan. 24, 2007 (GB) ..... 0701288.3

(51) Int. Cl.
*E21B 10/32* (2006.01)

(52) U.S. Cl. ..... 175/267; 175/279
(58) Field of Classification Search ..... 277/57, 277/263, 279, 267; 175/57, 263, 279, 267, 175/269, 277
See application file for complete search history.

(56) References Cited

U.S. PATENT DOCUMENTS

| | | | | |
|---|---|---|---|---|
| 4,842,082 | A | 6/1989 | Springer | |
| 6,041,874 | A * | 3/2000 | Lee | 175/101 |
| 6,991,046 | B2 * | 1/2006 | Fielder et al. | 175/57 |
| 7,703,553 | B2 * | 4/2010 | Eddison et al. | 175/269 |
| 2003/0155155 | A1 * | 8/2003 | Dewey et al. | 175/57 |
| 2003/0164251 | A1 * | 9/2003 | Tulloch | 175/57 |
| 2004/0060710 | A1 * | 4/2004 | Marshall | 166/381 |
| 2004/0134687 | A1 * | 7/2004 | Radford et al. | 175/57 |
| 2005/0092526 | A1 * | 5/2005 | Fielder et al. | 175/57 |
| 2005/0205305 | A1 * | 9/2005 | Stout et al. | 175/292 |
| 2006/0144623 | A1 * | 7/2006 | Ollerensaw et al. | 175/269 |
| 2007/0012440 | A1 * | 1/2007 | Lee | 166/216 |
| 2007/0089912 | A1 * | 4/2007 | Eddison et al. | 175/269 |
| 2007/0107944 | A1 * | 5/2007 | Lee | 175/317 |
| 2009/0277689 | A1 * | 11/2009 | Lee | 175/57 |

FOREIGN PATENT DOCUMENTS

| | | | |
|---|---|---|---|
| CA | 2407506 | A1 | 11/2001 |
| CA | 2506426 | A1 | 6/2004 |

* cited by examiner

*Primary Examiner* — Daniel P Stephenson
(74) *Attorney, Agent, or Firm* — Kirton & McConkie; Evan R. Witt

(57) ABSTRACT

An activating device is mounted in a drill string to control the activation and deactivation of an enlargement tool used for enlarging a bore hole. In order to assemble the activating device, pistons are mounted in passages and spline bars, in which plates are screwed, are then slid along T-slots of the body, through apertures of the pistons. In order to deploy the pistons and cutters, pressurized drilling fluid is applied to the inner faces of the pistons. When a pre-determined pressure level is reached, screws break and the pistons move from the inward position to the outwardly deployed position.

19 Claims, 14 Drawing Sheets

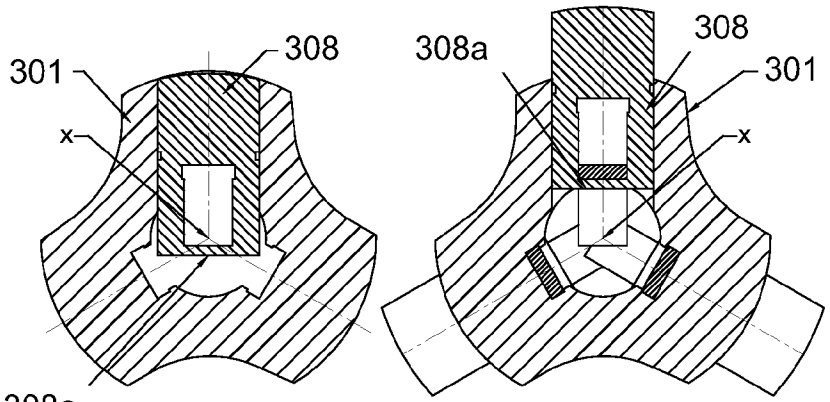
FIG. 35
FIG. 34
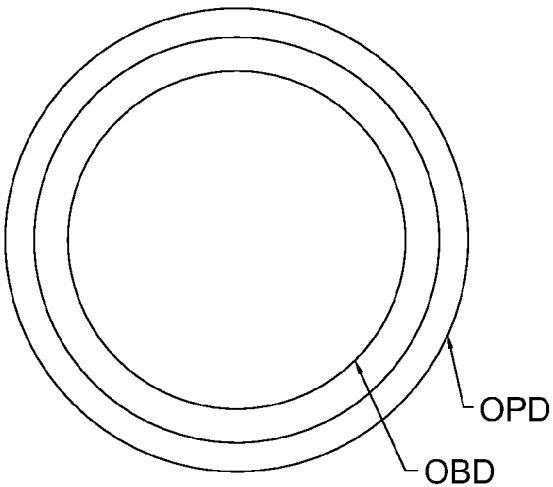
FIG. 36
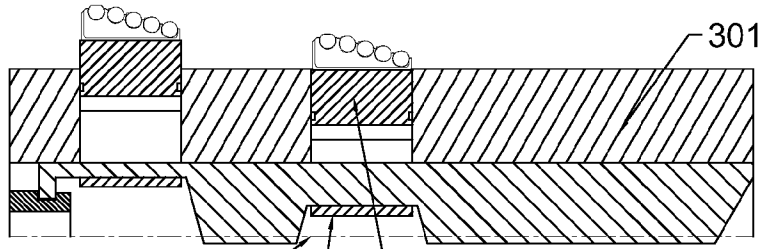
FIG. 33a
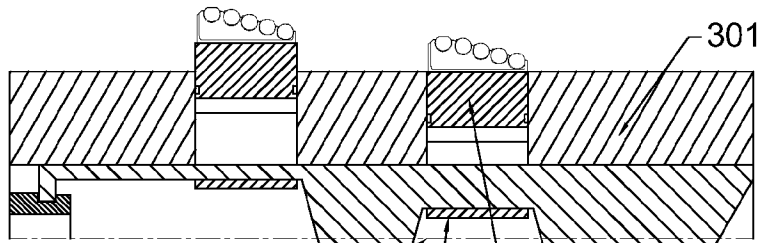
FIG. 33b
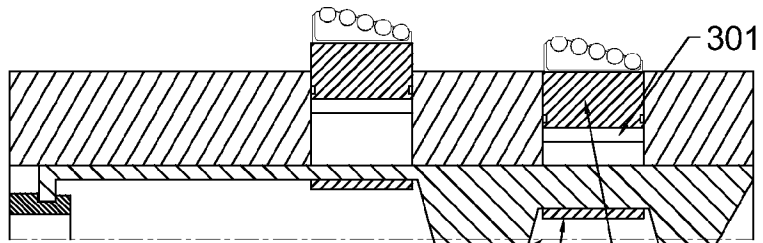
FIG. 33c

ACTIVATING DEVICE FOR A DOWNHOLE TOOL

BACKGROUND OF THE INVENTION

The present invention relates to an activating device for a downhole tool, and relates particularly, but not exclusively, to an activating device for controlling the activation and deactivation of an enlargement tool driven downwardly with a drill bit to enlarge a borehole through a formation to access a sub-surface reservoir of liquid and/or gaseous hydrocarbon.

An example of a downhole enlargement tool with which the activating device of the present invention may be used is an under reamer, although the activating device may be used with other downhole tools, such as a stabiliser etc.

Hole enlargement tools generally use pressure operated pistons which move outwardly from a tool body in order to displace working elements of the tool to an outwardly deployed position. The pressure used to operate the pistons comprises drilling fluid supplied under pressure to operate the drilling bit.

In some cases, with existing systems the pistons move in and out of the main body a number of times, depending upon the cycling of the tool. Various means have been used to retain the pistons, including dovetails provided on mandrels and caps retained with cap screws or bolts which in turn retain the pistons.

Some systems help to transmit torque on turning of the cutting pads of the tool in relation to the main body. Spring retention can be provided to push the pistons back into the main body when the tools are in the deactivated mode. Also, known systems have a pre-determined path of travel of the activating pistons between inward and outward limiting positions, namely an inward inoperative position and an outwardly deployed operative position. By moving between the limiting positions, there is no means of adjustment of the length of the path of travel of the pistons to provide different diameters of hole enlargement if required.

Existing systems have used shear pins to hold pistons in the tool body in the inward deactivated position. The shear pins are arranged to break as a result of fatigue from the force applied by a predetermined number of tool cycles. However, this can result in the shear pins breaking too early resulting in unwanted piston deployment.

Furthermore, in existing systems the torque applied to the cutting elements of the enlargement tool is fed back directly to the activating pistons, which is disadvantageous because it increases friction between the pistons and the bores in which the pistons are held and therefore increases wear and tear which can eventually lead to malfunction of the pistons.

Moreover, existing tools are generally constructed by mounting the pistons in their respective passages and then bolting the pistons in from the outside. The bores for the bolts provide paths for leakage.

The present invention therefore seeks to provide an improved activating device for a downhole tool, in which the extent of radial outward movement of the piston may be varied if required, to vary the outward projection of the cutting elements of the enlargement tool, and to at least reduce the frictional feedback to the pistons during rotation of the enlargement tool. The present invention also seeks to provide a tool having improved sealing against leakage with fewer sealing elements. The present invention also seeks to provide an improved method of retaining pistons in the inward deactivated position.

SUMMARY OF THE INVENTION

According to the present invention, there is provided an activating device for a downhole tool, the activating device comprising:

a body having at least one piston slidably mounted in the body for movement between an inward deactivated position and an outwardly deployed activated position, wherein at least one said piston comprises an aperture formed therein;

activating means for delivering a supply of fluid under pressure in order to urge at least one said piston outwardly into the deployed activated position; and at least one retainer removably mountable in the body to project through in to at least one said aperture to retain the corresponding piston in the body and resist rotation of the piston relative to the body.

By providing at least one retainer removably mountable in the body to project through at least one said aperture to retain the corresponding piston in the body and resist rotation of the piston relative to the body, this provides the advantage that the retainer defines the inner and outward limits of the movement of the piston. Also, because the retainer is removable, different sized retainers can be mounted in the body to change the extent to which the pistons project from the body. Abutment between the aperture walls and the retainer also provides the advantage of preventing rotation of the piston relative to the body and helps to reduce friction between the pistons and the bores in which the pistons are held. Furthermore, a removable retainer enables the tool to be easily assembled and disassembled for cleaning, repair and re-use. Moreover, this provides the advantage that the tool can be assembled by mounting the piston in the body and then sliding the retainer through the piston to retain the piston. This means that the piston does not have to be bolted in from the outside which reduces the number of paths for leakage and therefore improves sealing.

In a preferred embodiment, the device further comprises a plurality of retainers removably mountable in the body, each said retainer having a different height and wherein each said retainer projects through an aperture in a corresponding piston to enable each said piston to be outwardly deployed from the body to a different extent.

This provides the advantage that several pistons can be outwardly deployed to a different height in order to enable cutting elements mounted to the pistons to form a profiled cutting surface.

At least one said retainer may comprise a spline bar slidably mountable in a keyway formed in the body.

Said keyway may have a substantially T-shaped cross section and at least one said spline bar may comprise a corresponding T-shape.

At least one said retainer may comprise at least one cam surface for engaging a base of the aperture of at least one said piston to retain the piston in the inward deactivated position, and wherein at least one said retainer is slidable relative to the body into a position in which at least one said cam surface does not engage the base of said aperture to enable at least one said piston to move into the outwardly deployed activated position.

This provides the advantage of a relatively straightforward method of retaining the pistons in the inward deactivated position until they are required to be deployed. When the pistons are required to be deployed, the retainer can be moved under pressure to release the pistons to enable them to be moved into the outwardly deployed activated position. Alternatively, the retainer can be moved under weight to move the cam surfaces.

The device may further comprise at least one screw connecting at least one said retainer to at least one said piston, wherein the screw holds at least one said piston in the inward deactivated position and the screw is adapted to break on delivery of a supply of fluid under pressure to enable at least one said piston to move outwardly into the outwardly deployed activated position.

This provides the advantage of a relatively straightforward method of retaining the pistons in the inward deactivated position. Screws can be chosen such that they break at a predetermined level of pressure to enable the pistons to move to the outwardly deployed activated position.

At least one said piston may comprise a slot disposed adjacent the aperture, and wherein a plate is slidably mountable in said aperture, the plate adapted to receive at least one said screw to enable at least one said retainer to be connected to at least one said piston.

This provides the advantage that the screw, plate and spline bar can easily be replaced in order to make the tool re-useable.

In a preferred embodiment, at least one said screw is aligned with a radius of the tool.

This provides the advantage that the screw can be arranged to break when a predetermined level of force is applied. The tensile strength of a screw is known, such that if the screw is oriented such that it is aligned with the radial direction of the tool, i.e. the direction along which a piston moves, the piston can be arranged to deploy at a predetermined pressure level.

The device may further comprise biasing means arranged to bias at least one said piston into the inward deactivated position.

Said biasing means may comprise a leaf spring engageable with a base of the aperture of at least one said piston to bias said piston into the inward deactivated position.

The device may further comprise a plurality of pistons slidably mounted in the body, wherein said each said piston is disposed at a different position along a longitudinal axis of the body such that the inner ends of the pistons do not overlap.

By ensuring that the inner end of the pistons do not overlap in the body, larger pistons can be used which means that the pistons can be outwardly deployed to a further extent. Conventional downhole tools having expandable pistons generally have sets of three pistons disposed at 120 degrees around the circumference of the body but at the same longitudinal position. This means there is a limit to the inward extent in the body to which the pistons can move. By spacing the pistons along the axis, the pistons can be withdrawn further into the body meaning that larger pistons can be used.

The device may further comprise at least one protective sleeve disposed between at least one respective piston and the body.

This provides the advantage of reducing wear and tear on the pistons and the body because the wear and tear is taken up by the protective sleeve. Reduced wear and tear on the body reduces cost and occurrence of malfunction.

One of the sleeve and body may comprise a shoulder arranged to abut a recess formed on the other of the respective body and sleeve to retain the sleeve in the body.

The activating means for delivering a supply of fluid under pressure in order to urge at least one said piston outwardly into the deployed activated position may comprise a ported mandrel arranged to move along a longitudinal axis of the tool in response to an increase in fluid pressure, such that alignment of at least one port disposed on the mandrel with a piston chamber enables fluid to flow into a piston chamber and urge at least one said piston in to the outwardly deployed activated position.

This provides the advantage that the ports of the mandrel can be dimensioned to prevent debris larger than a predetermined size present in the drilling fluid from entering the piston chamber. This minimises damage to the piston chamber and also prevents the outer tool nozzles from becoming blocked.

In a preferred embodiment, said ported mandrel further comprises a flanged portion arranged at an end of the mandrel, the flanged portion arranged to abut a retaining shoulder formed on the body.

The passages formed in the body in which the pistons are slidably mounted are weak points of the device, and if they device breaks it is likely to happen at one of these points. Consequently, by providing a flanged portion arranged at an end of the mandrel, the flanged portion arranged to abut a retaining shoulder formed on the body, this provides the advantage that the mandrel can be used to keep the body parts together such that the mandrel can be used to retrieve the broken tool from a borehole.

Said flanged portion may be formed by at least one retaining nut disposed on the ported mandrel.

The body may comprise a main body portion, a top sub and a bottom sub, wherein said retaining portion is formed on the bottom sub.

BRIEF DESCRIPTION OF THE DRAWINGS

Preferred embodiments of the present invention will now be described, by way of example only and not in any limitative sense, with reference to the accompanying drawings in which:

FIG. 33*a* is a first longitudinal cross section of the body of FIGS. 31 and 32 showing the first two pistons;

FIG. 33*b* is a second cross section at the same longitudinal position on the body showing the second set of pistons 120 degrees further around the body than the pistons of FIG. 33*a;*

FIG. 33*c* is a third cross section through the body corresponding to FIGS. 33*a* and 33*b* taken 120 degrees further round the body from the position of FIG. 33*b* showing the third set of pistons;

FIG. 34 is a transverse cross section through the body showing one of the pistons of FIG. 31 in the inwardly deactivated position;

FIG. 35 is a transverse cross section through the body taken at three points showing three pistons in the outwardly deployed activating positions;

FIG. 36 is a representation of the dimensions of the tool of FIGS. 31 to 35;

DETAILED DESCRIPTION

Figure 1:
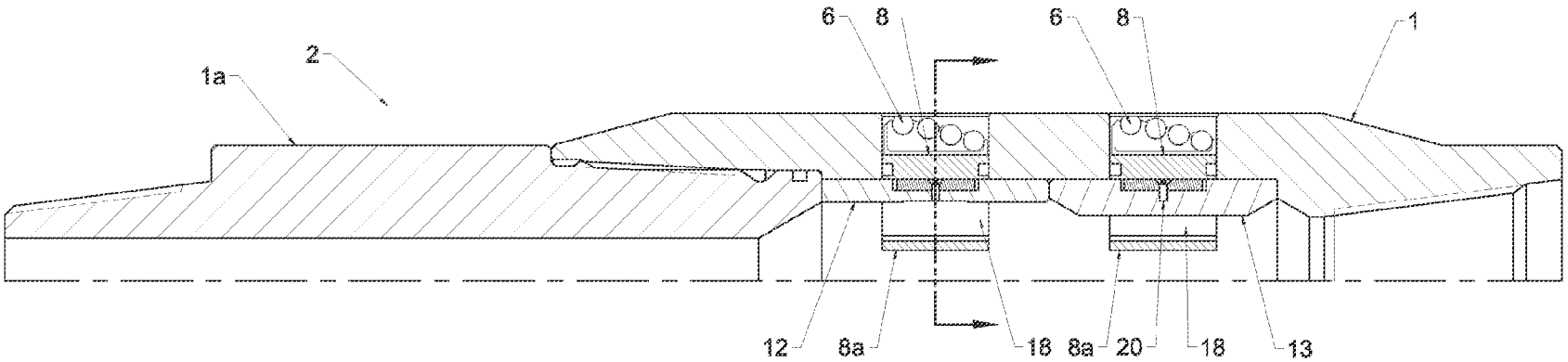
FIG. 1 is a longitudinal cross sectional view of an activating device of a first embodiment of the present invention showing pistons in the inward deactivated positions.
Figure 2:
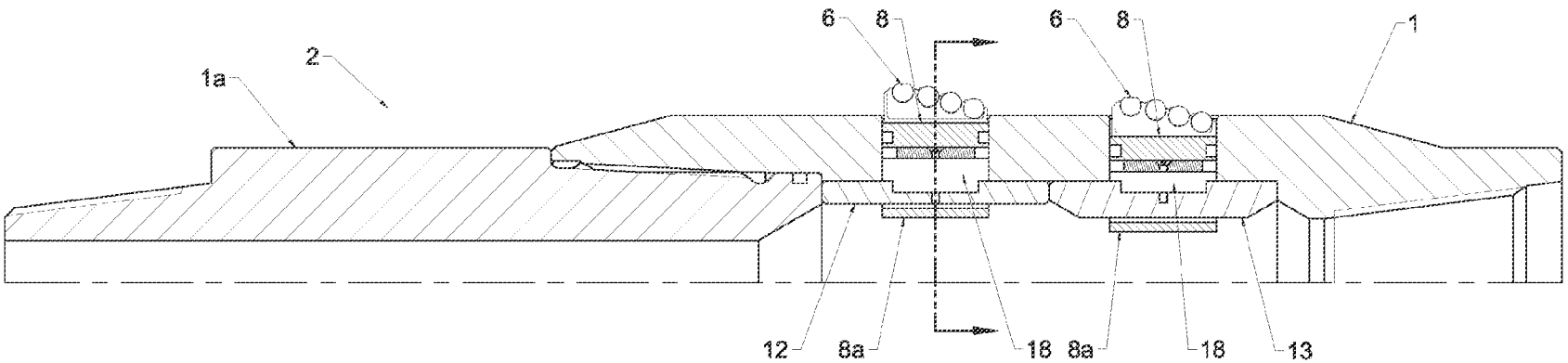
FIG. 2 is a longitudinal cross section of the activating device of FIG. 1 showing the pistons in the outwardly deployed activated position.
Figure 3:
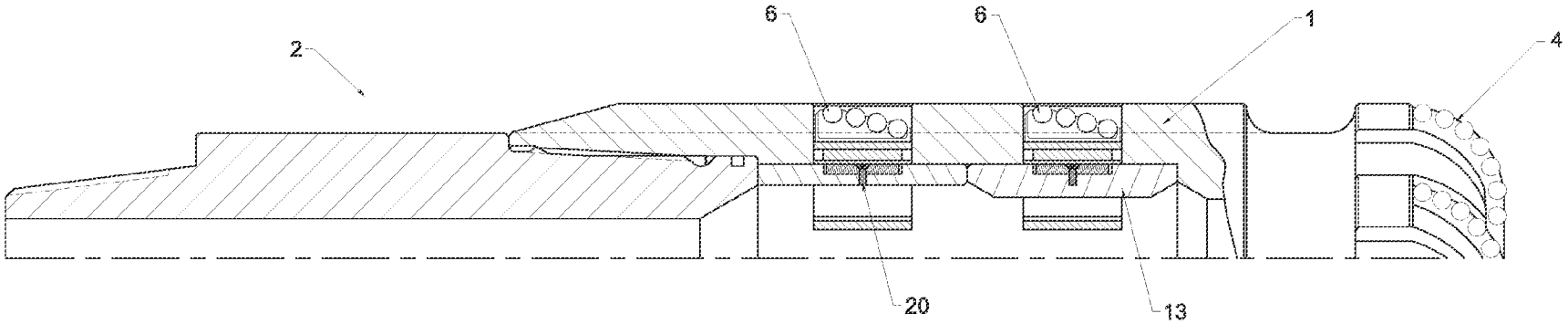
FIG. 3 is a longitudinal cross sectional view of an activating device corresponding to FIG. 1 showing the drill bit of the downhole tool to which the activating device is attached.
Figure 4:
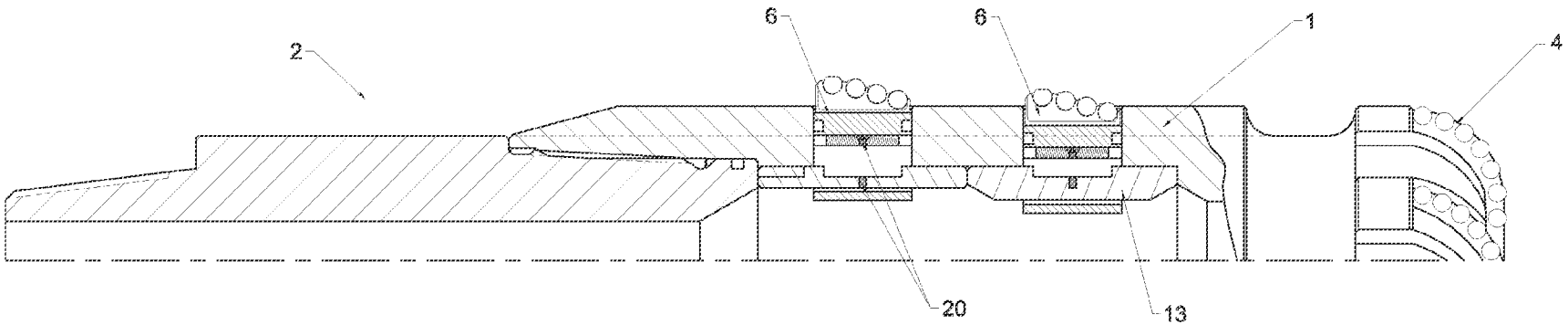
FIG. 4 is a longitudinal cross sectional view corresponding to FIG. 2 showing the drill bit of the downhole tool to which the activating device is attached.
Figure 5:
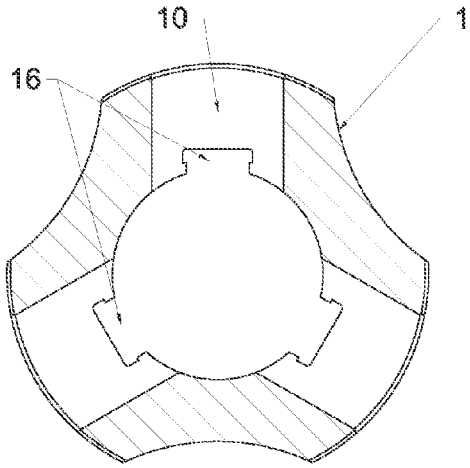
FIG. 5 is a transverse cross sectional view of the body of FIG. 1.
Figure 6:
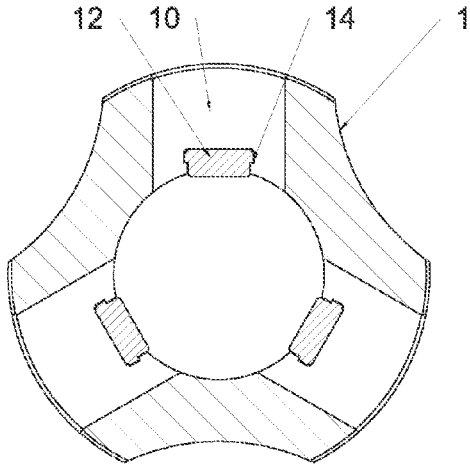
FIG. 6 is a cross sectional view corresponding to FIG. 5 in which spline bars are mounted in the body.
Figure 7:
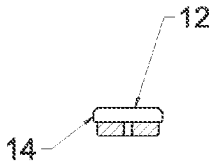
FIG. 7*a* is transverse cross sectional view of a spline bar.
FIG. 7*b* is a side view of a spline bar.
Figure 7A:
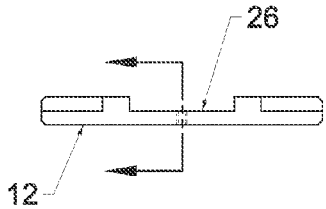
Figure 8A:
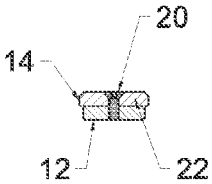
FIG. 8*a* is a view corresponding to FIG. 7*a* in which a plate is mounted in the spline bar.
Figure 8B:
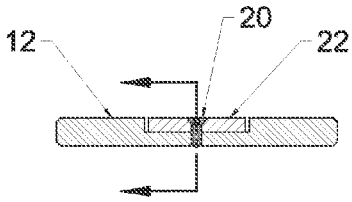
FIG. 8*b* is a view corresponding to FIG. 7*b* in which a plate is mounted in the spline bar.
Figure 9:
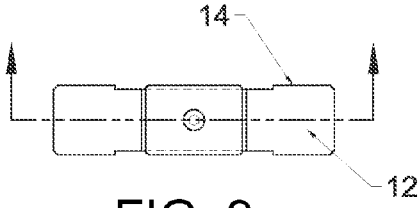
FIG. 9 is a top view of the spline bar in which a plate is mounted.

Referring to FIGS. 1 to 4, an activating device is designated generally by reference numeral 2 and is in intended to be mounted in a drill string in order to control the activation and deactivation of an enlargement tool used for enlarging a bore hole. For example, a drill bit 4 forms the bore hole and the activating device is used to control the deployment of cutters 6 to enlarge the bore hole.

Figure 10A:
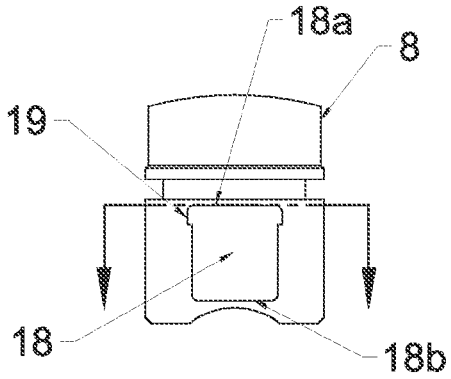
FIG. 10*a* is a side view of an activating piston.
Figure 10B:
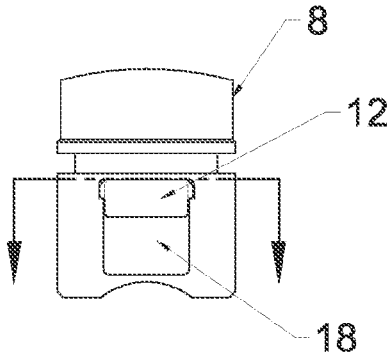
FIG. 10*b* is a side view of the piston of FIG. 10*a* in which a plate is mounted.
Figure 11A:
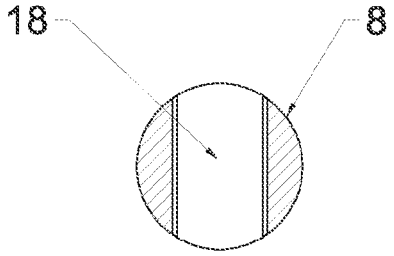
FIG. 11*a* is a cross section through the piston.
Figure 11B:
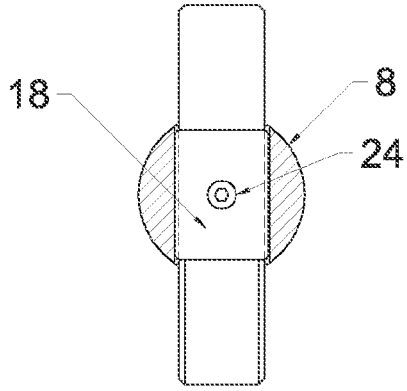
FIG. 11*b* is a cross section corresponding to FIG. 11*a* in which a plate is mounted.
Figure 12A:
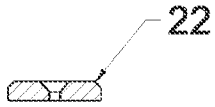
FIG. 12*a* is a side view of the plate.
Figure 12B:
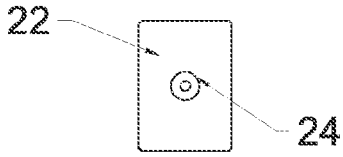
FIG. 12*b* is a top view of the plate.

An example of an enlargement tool is an under reamer used for enlarging a borehole to access a sub-surface reservoir of liquid and/or gaseous hydrocarbon. Cutter elements 6 are mounted to pistons 8 (FIGS. 10 and 11) which are moveable between an inward deactivated position shown in FIGS. 1, 3 and 13 and an outwardly deployed activated position shown in FIGS. 2, 4 and 14. Pistons 8 are moveable into the outwardly deployed activated positions on supply of drilling fluid under pressure to the inner surfaces 8*a* of pistons 8. For example, as will be apparent to persons skilled in the art, the differential pressure between the inside and the outside of the tool may cause the pistons to deploy. Alternatively, the pistons 8 could be caused to be deployed by means of weight. The pistons 8 are slidably mountable in passages 10 formed in body 1. Referring to FIGS. 5, 6, 13 and 14, three passages 10 and therefore three pistons 8 are provided on the body 1 spaced apart by 120°.

Referring to FIGS. 1, 2, 5 to 9 and 13 and 14, a removable retainer such as a spline bar 12 has a T-shaped cross section and comprises wings 14. T-slots 16 are formed in the body 1 such that the spline bars 12 are slidably mountable in T-slots 16. Consequently, wings 14 prevent the spline bars 12 from moving radially in the body 1. Also, since spline bars 12 are slidably movable in T-slots 16, they are easily removable and can be replace with smaller or larger spline bars to change the extent to which the pistons 8 are able to project from body 1.

Figure 14:
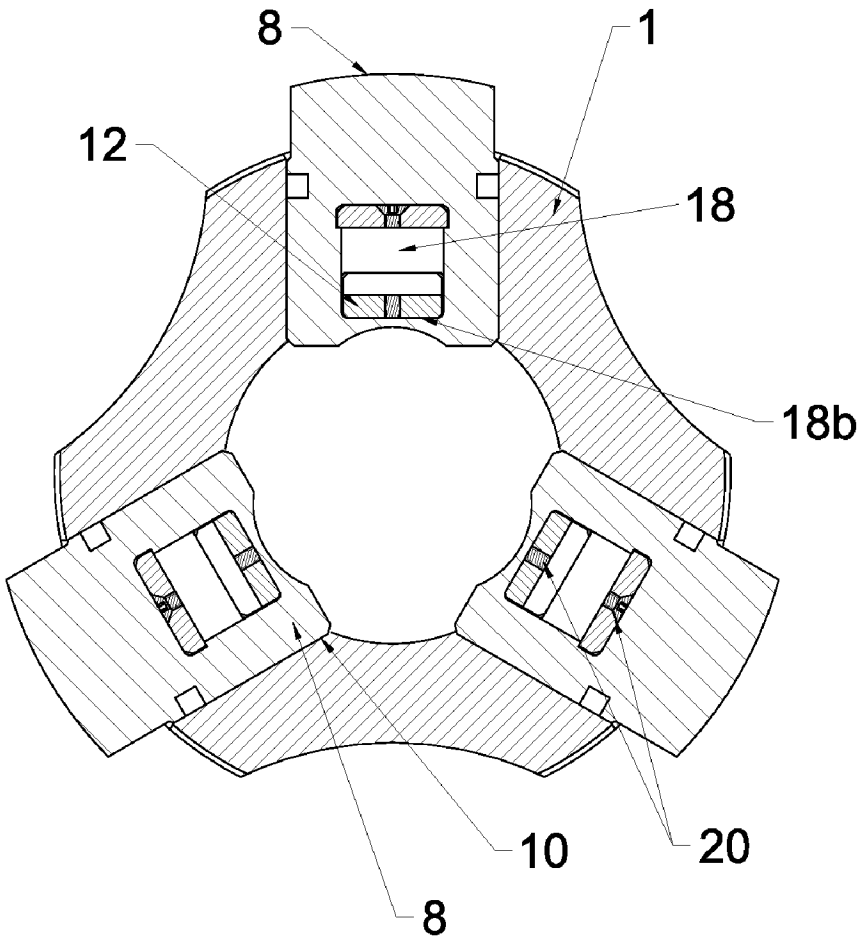
FIG. 14 is a transverse cross section of the activating device, including a portion taken through line B-B of FIG. 2.
Figure 13:
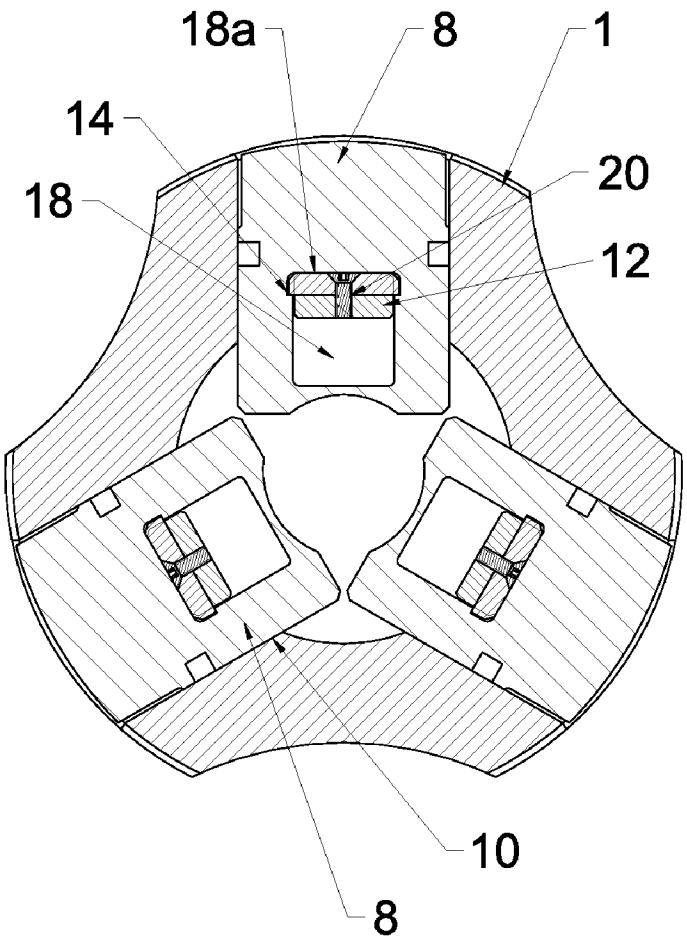
FIG. 13 is a transverse cross section of the activating device, including a portion taken through line A-A of FIG. 1.

Referring to FIGS. 1, 2, 10, 11, 13 and 14, an aperture 18 is formed through each piston 8. Apertures 18 are shaped to slidably receive spline bars 12. The spline bars may partially or entirely project through the apertures 18. Consequently, spline bars 12 limit the inward and outward deployment of the pistons 8 by engagement with the upper and lower walls 18*a* and 18*b* of pistons 8. For example, FIG. 13 shows spline bar 12 in engagement with upper wall 18*a* of aperture 18. This defines the inward deactivated position of piston 8. Referring to FIG. 14, piston 8 is shown in a position in which spline bar 12 engages the lower wall 18*b* of aperture 18. This defines the outwardly deployed activated position of piston 8. Furthermore, as shown FIGS. 1 to 4, spline bar 12 can have different sizes. For example, a larger spline bar 13 enables piston 8 to be outwardly deployed to a lesser extent to enable cutters 6 to form a profiled cutting surface. Both spline bars 12 and 13 are slidably mountable and interchangeable in T slots 16.

Referring to FIGS. 1 to 4 and 7 to 14, in order to retain the pistons in the inward deactivated positions before they are required for use, plates 22 are be provided, the plates having a threaded hole 24 for receiving breakable screw 20. Plate 22 is shaped to be slidably mountable in T slots 19 formed in the piston 8. The plates 22 are also mountable in recesses 26 formed in spline bars 12. When the tool is assembled, screws 20 are aligned with the radius of the tool, i.e. the direction perpendicular to the longitudinal axis of the tool. This provides the advantage that the screw can be arranged to break when a predetermined amount of force is applied. The tensile strength of the screw is relatively predictable, such that if the screw is oriented such that it is aligned with the radial direction of the tool, i.e. the direction along which a piston moves, the piston can be arranged to deploy at a predetermined pressure level.

The operation of the activating device 2 of FIGS. 1 to 14 will now be described. In order to assemble the activating device, pistons 8 are mounted in passages 10 and then spline bars 12 in which plates 22 have been screwed with screws 20 are slid along T slots 16 of the body 1, through apertures 18 of the pistons. A top sub la of the body can then be mounted in order to retain the spline bars 12 and 13 in place. It can therefore be seen that this method of assembly avoids the need for bolting the pistons in from the outside of the tool. This improves sealing.

In order to deploy the pistons 12 and cutters 6, pressurised drilling fluid is applied to the inner faces 8*a* of the pistons 8. When a pre-determined pressure level is reached, a predetermined force corresponding to the tensile strength of screws 20 is applied, causing screws 20 break and the pistons to move from the inward position 13 to the outwardly deployed position shown in FIGS. 2 and 14. It can be seen that spline bars 12 limit both the inward and outward movement of the pistons 8. Also, the spline bars 12 prevent rotation of the pistons 8 about their longitudinal axes.

An activating device of a second embodiment of the invention is shown in FIGS. 15 to 28, with parts common to the embodiment of FIGS. 1 to 14 denoted by like reference numerals but increased by 100.

Activating device 102 comprises a body 101 having passages 110 in which pistons 108 are disposed. Cutters 106 are mounted on the ends of pistons 108.

Figure 15:
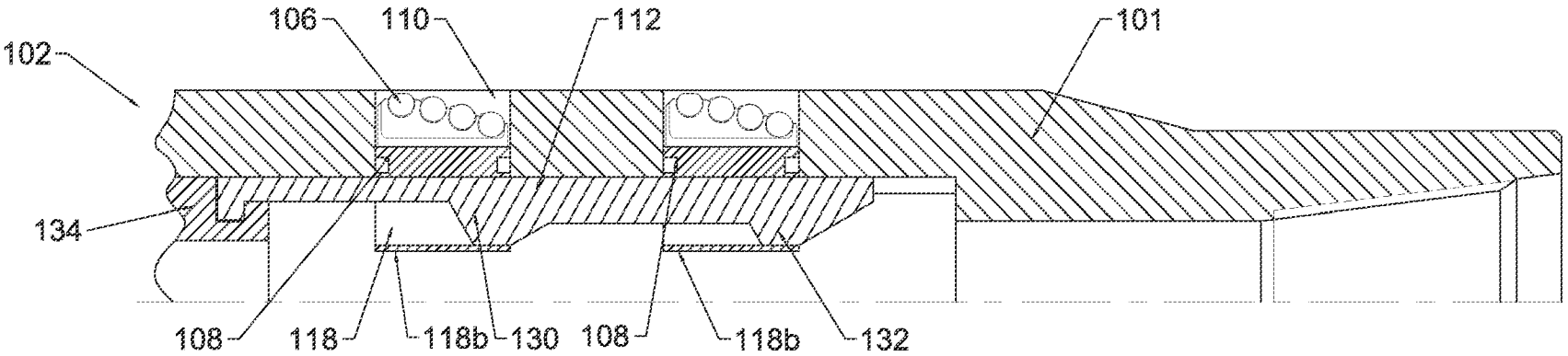
FIG. 15 is a longitudinal cross sectional view of an activating device of a second embodiment of the present invention showing pistons in the inward deactivated position.
Figure 16:
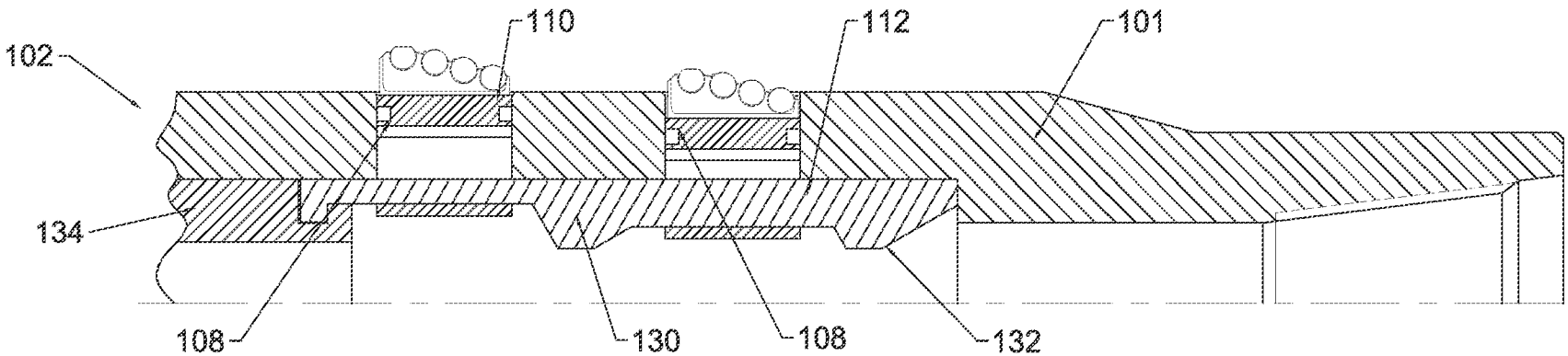
FIG. 16 is a longitudinal cross sectional view corresponding to FIG. 15 showing the pistons in the outwardly deployed activated position.
Figure 17:
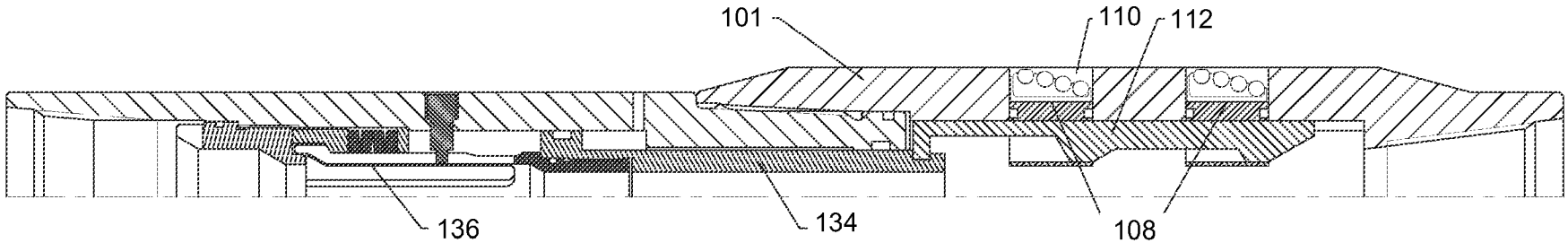
FIG. 17 is a view corresponding to FIG. 15 showing the piston activation sleeve.
Figure 18:
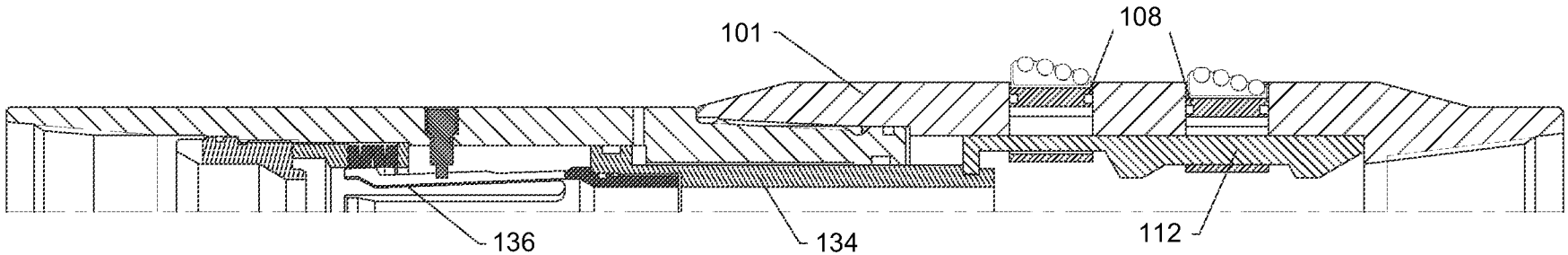
FIG. 18 is a view corresponding to FIG. 17 showing the pistons in the outwardly deployed activated position.
Figure 19:
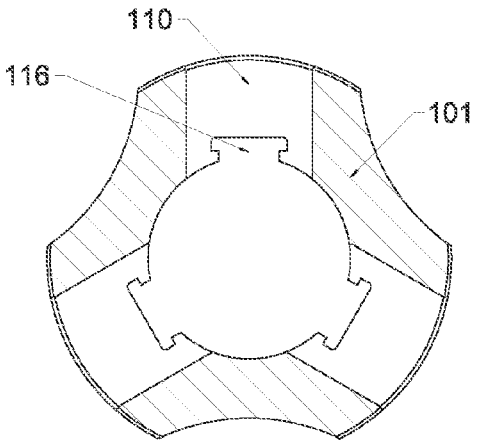
FIG. 19 is a transverse cross sectional view of the tool of FIG. 15.
Figure 20:
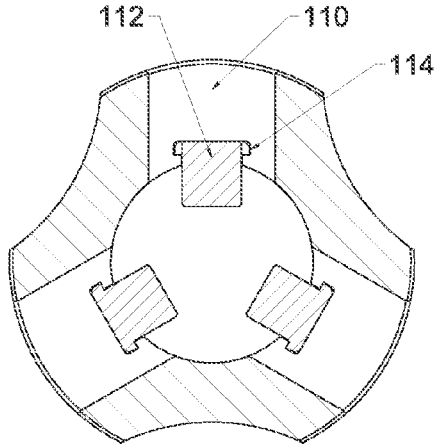
FIG. 20 is a cross section corresponding to FIG. 19 showing the spline bars mounted in the tool.
Figure 21:
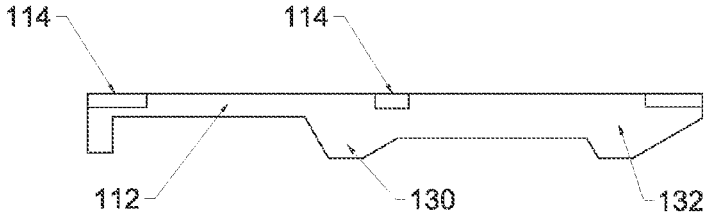
FIG. 21 is a side view of the spline bar of FIG. 15.
Figure 22:
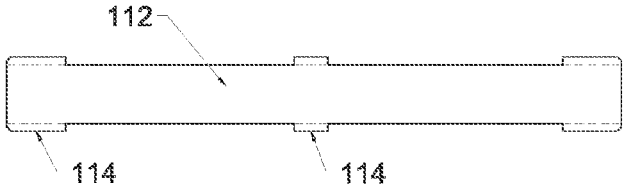
FIG. 22 is a top view of the spline bar of FIG. 21.
Figure 23:
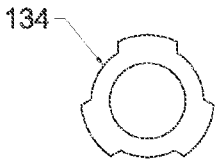
FIG. 23 is an end view of the piston activation sleeve.
Figure 24:
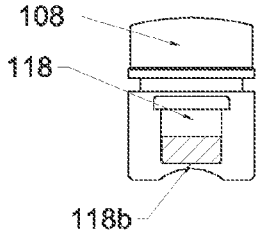
FIG. 24 is a side view of a piston showing the piston engaging the spline bar in the outwardly deployed activating position.
Figure 25:
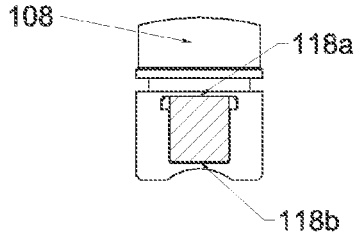
FIG. 25 is a side view of a position showing a cam surface of the spline bar engaging the piston to retain the piston in the inward deactivated position.
Figure 26:
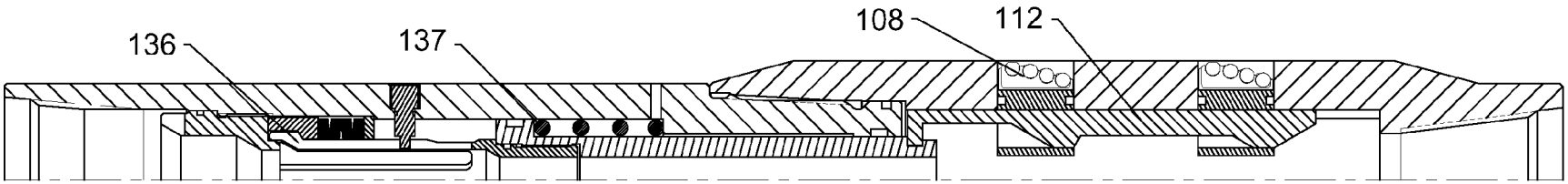
FIG. 26 is a view corresponding to FIG. 15 showing the piston activation sleeve.
Figure 27:
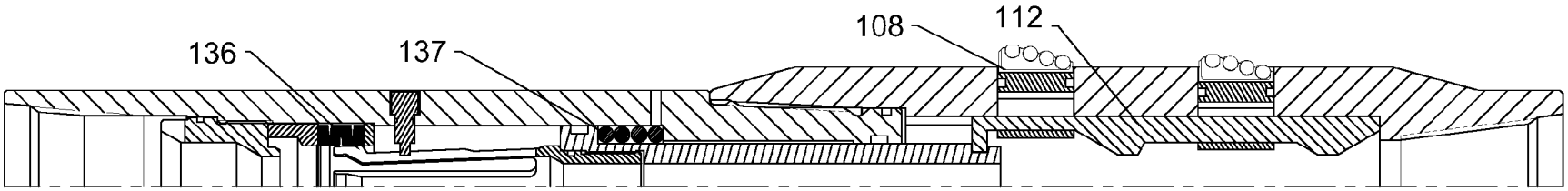
FIG. 27 is a view corresponding to FIG. 16 showing the piston activation sleeve.
Figure 28:
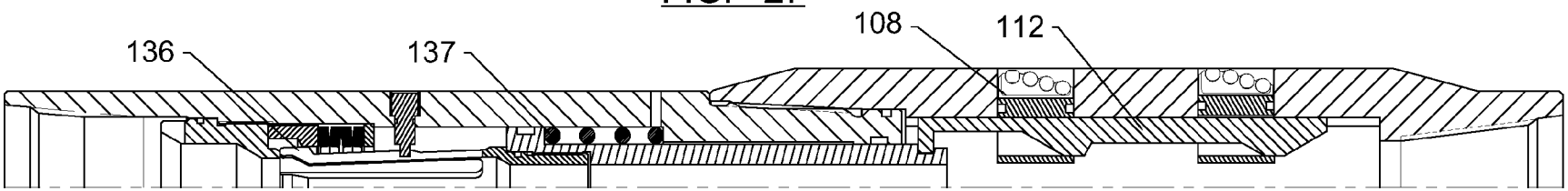
FIG. 28 is a view corresponding to FIGS. 26 and 27 showing the piston activation sleeve in an intermediate position.

Spline bar 112 comprises first and second cam surfaces 130 and 132 and spline bar 112 also comprises wings 114. Body 101 comprises T slots 116 in which the spline bars 112 are slidably mountable. Referring to FIGS. 15 and 16, spline bar 112 is moveable along the longitudinal axis of the body 101 from the position of FIG. 15 in which cam surfaces 130 and 132 abut the lower surfaces 118*b* of apertures 118 to retain the piston 108 in the inward deactivated positions. On operation of a piston activation sleeve 134 to axially advance the piston activation sleeve 134, the spline bar 112 is moveable into the position shown in FIG. 16 to release pistons 108 and enable the pistons to be outwardly deployed.

Piston activation sleeve 134 can be moveable under the same supply of fluid pressure that deploys pistons 108. A latch member 136 is provided such that the piston activation sleeve will not advance until a predetermined pressure differential between the inside and outside of the tool is reached. Alternatively, latch member 136 could be moved by launching a ball (not shown) as will be readily apparent to persons skilled in the art. Alternatively, piston activation sleeve could be moved by weight as will be apparent to persons skilled in the art. A coil spring 137 (FIGS. 26 to 28) is provided to bias the latch member 136 in to the closed condition in order to prevent deployment of the pistons until required.

Figure 29:
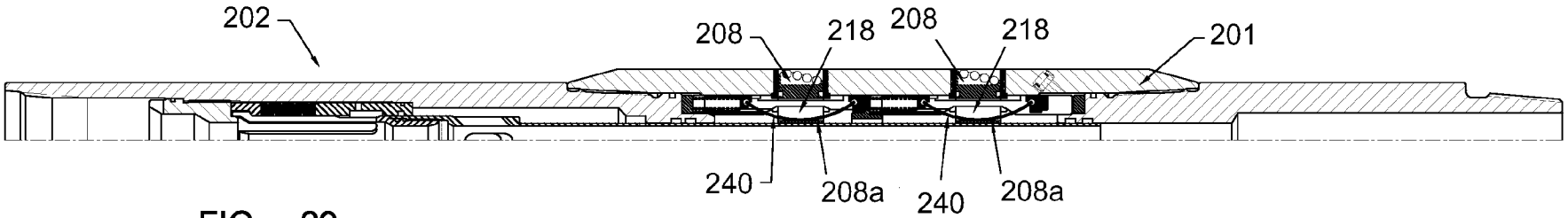
FIG. 29 is a longitudinal cross sectional view of an activating device of a third embodiment of the present invention showing pistons held in the inward deactivated position by a leaf spring.
Figure 30:
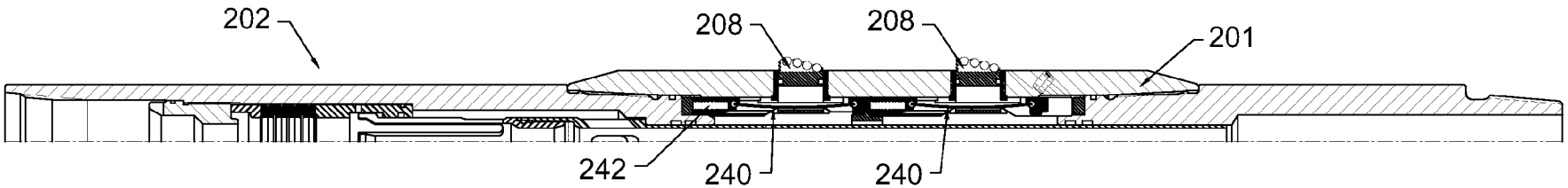
FIG. 30 is a cross section corresponding to FIG. 29 showing the pistons in the outwardly deployed activated position with the leaf spring in the compressed condition.

An activating device of a third embodiment of the invention is shown in FIGS. 29 and 30, with parts common to the embodiment of FIGS. 1 to 14 denoted by like reference numerals but increased by 200.

Activating device 202 comprises a body 201 in which pistons 208 are slidably mounted. Leaf springs 240 project through apertures 218 of pistons 208. Leaf springs 218 abut lower walls 218*b* of apertures 218. Consequently, as shown in FIG. 29 the leaf springs bias the pistons 208 into the deactivated position. On supply of fluid under pressure to the bases 208*a* of pistons 208, pistons 208 are outwardly deployed and the leaf springs 240 are placed under compression. Return compression springs 242 may bias leaf springs 240 to hold the pistons 208 in the deactivated position.

An activating device of a fourth embodiment of the invention is shown in FIGS. 31 to 36, with parts common to the embodiment of FIGS. 1 to 14 denoted by like reference numerals but increased by 300.

Figure 31:
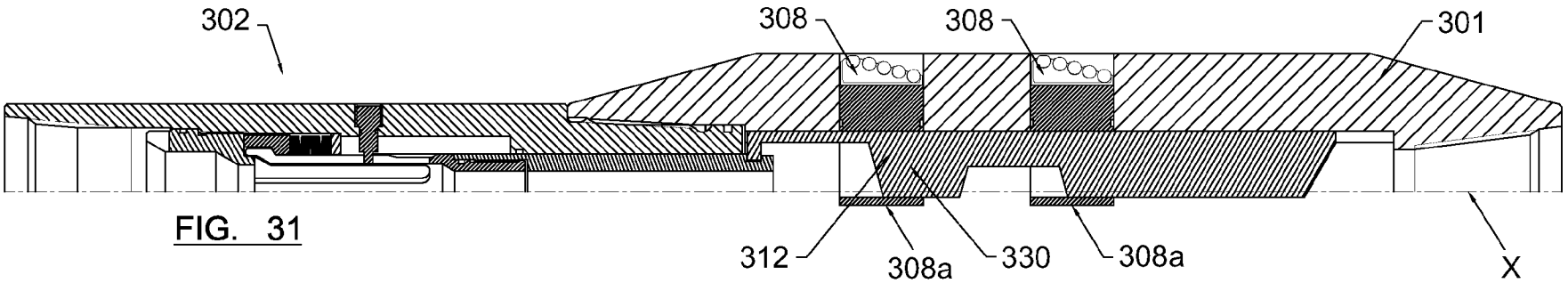
FIG. 31 is a longitudinal cross section of an activating device of a fourth embodiment of the present invention showing the pistons in the inward deactivated position.
Figure 32:
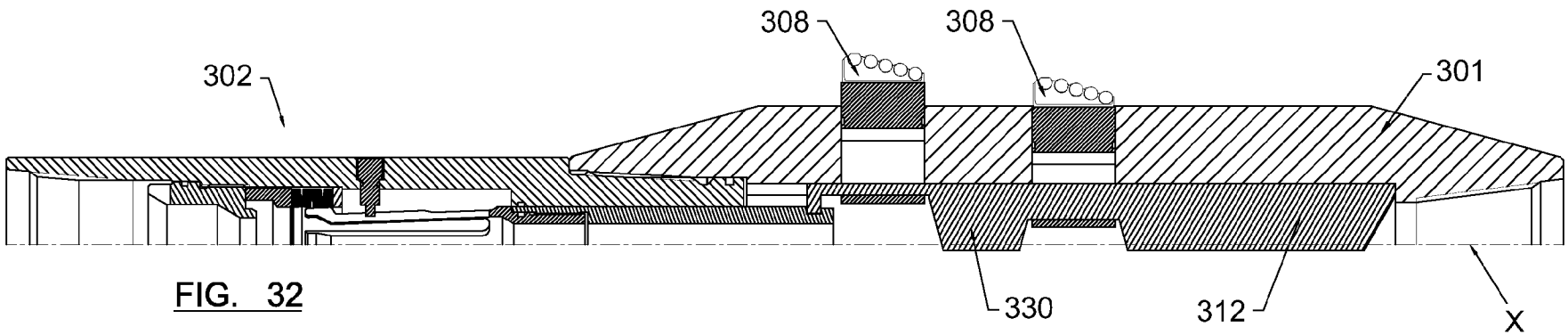
FIG. 32 is a cross section corresponding to FIG. 31 showing the pistons in the outwardly deployed activating positions.

Activating device 302 comprises a body 301 in which a plurality of pistons 308 are slidably mounted. Spline bar 312 comprises cam surfaces 330 for retaining the pistons in the inward deactivated condition as described above. In FIG. 31, it can be seen that the inner ends 308*a* of pistons 308 extend across the central longitudinal axis X of the body 301. The inner ends of the pistons in the first three embodiments do not extend across this axis. As a result of the fact that inner ends 308*a* can extend further into the body than the pistons of the first three embodiments, the pistons can be larger and therefore extend further outwardly of the body.

Referring to FIG. 36, for a tool having an outer body diameter OBD of 17.5 inches, the diameter of the tool OPD where the pistons are at their furthest extent from the body can be made as large as 24 inches if the inner ends 308 of the pistons can extend across axis X.

Referring to FIGS. 33*a* to 33*c*, for a body having six pistons, if each piston is offset from one another along the longitudinal axis X of the body 301 then the above result of enabling the inner ends 308*a* of the pistons 308 to extend across axis X in the inward deactivated position can be achieved. FIGS. 33*a* to 33*c* show three slices through the body respectively advanced 120 degrees from each other to show the longitudinal offset of the pistons 308.

Figure 38:
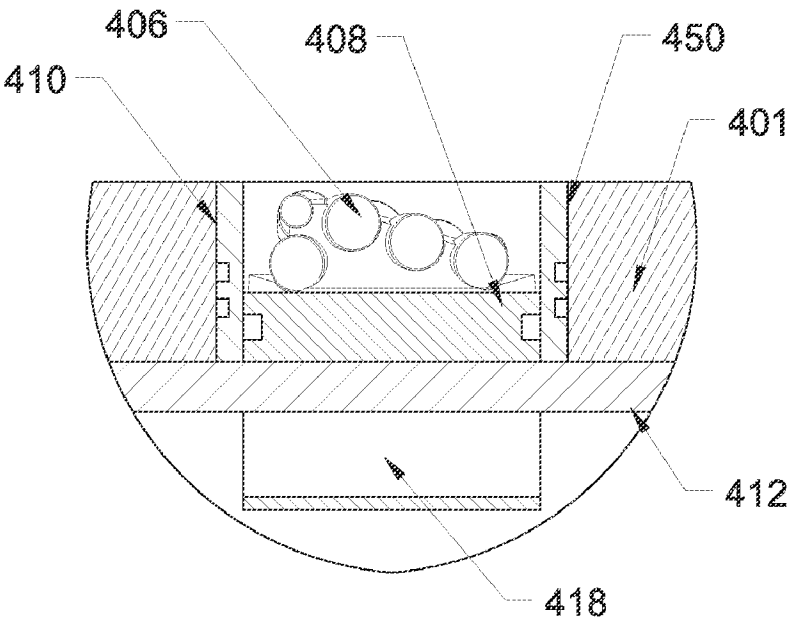
FIG. 38 is a longitudinal cross section corresponding to FIG. 37.
Figure 37:
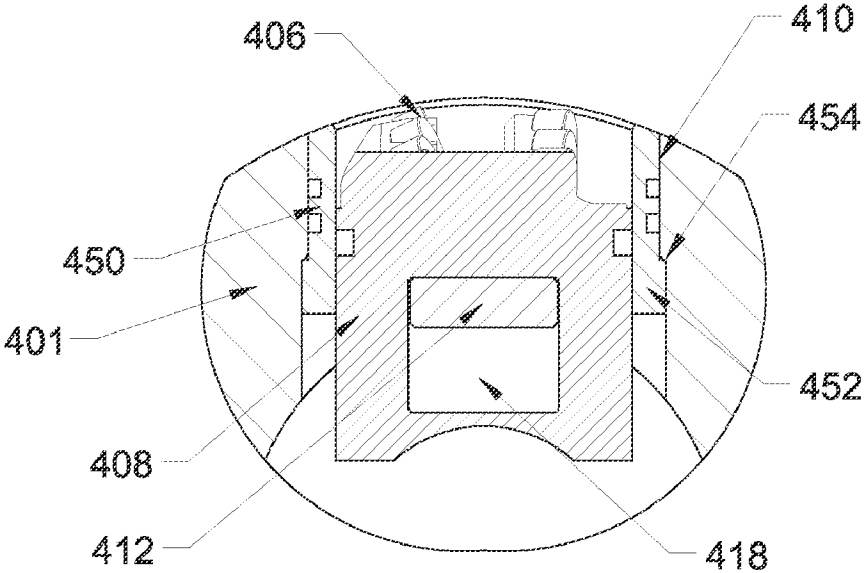
FIG. 37 is a transverse cross section of an activating device of a fifth embodiment of the present invention showing a protective piston sleeve surrounding a piston in the inwardly deactivated position.

An activating device of a fifth embodiment of the invention is shown in FIGS. 37 and 38, with parts common to the embodiment of FIGS. 1 to 14 denoted by like reference numerals but increased by 400.

Piston 408 comprises cutters 406. The piston 408 is retained in body 401 by a spline bar 412 extending through aperture 418 in the piston. A protective sleeve 450 is disposed between piston 408 and the passage 410 in which the piston is slidably mounted. Protective sleeve 450 is retained in the body by abutment of a shoulder 452 against a recess 454

Protective sleeve 450 may be formed from a harder material than that of the piston and the body. For example, protective sleeve 450 may be formed from tungsten carbide or a chrome material whereas the body and piston are generally formed from steel. Protective sleeve 450 therefore reduces wear and tear of the body due to torque transmitted from the pistons 408 during rotation of the tool.

Figure 39:
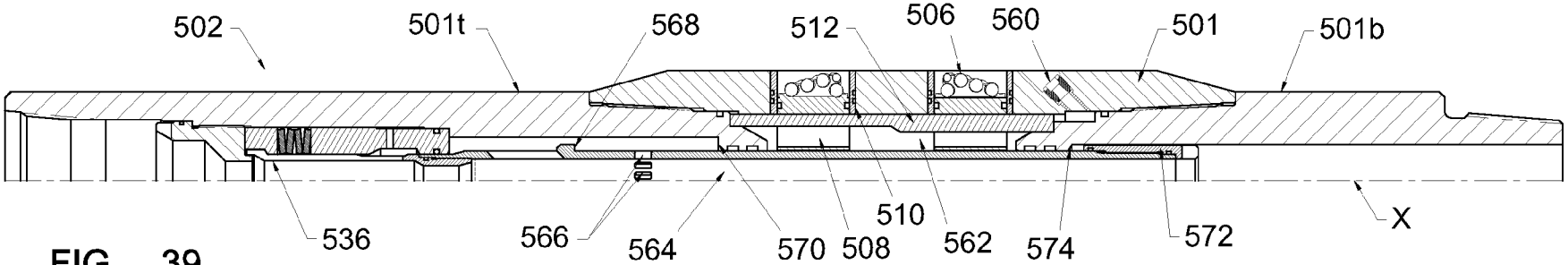
FIG. 39 is a longitudinal cross section of an activating device of a sixth embodiment of the present invention comprising a ported mandrel and showing the pistons in the inward deactivated position.
Figure 40:
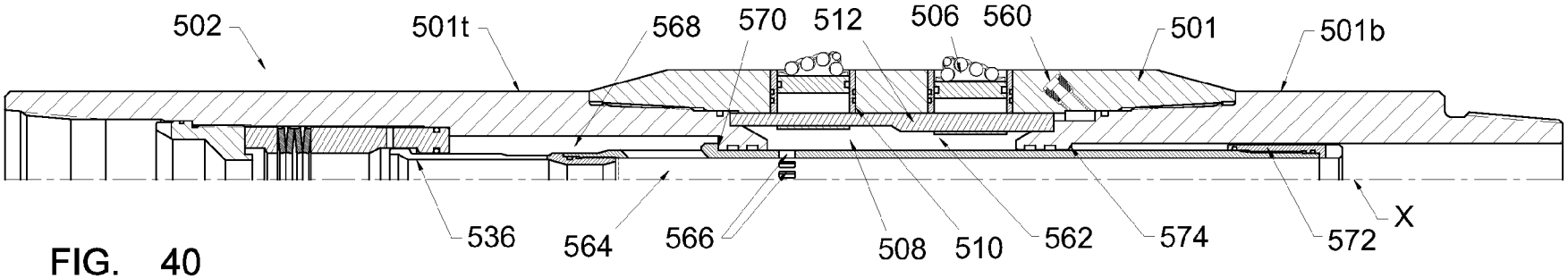
FIG. 40 is a longitudinal cross section corresponding to FIG. 39 showing the pistons in the outwardly deployed activating positions.

An activating device of a sixth embodiment of the invention is shown in FIGS. 39 and 40, with parts common to the embodiment of FIGS. 1 to 14 denoted by like reference numerals but increased by 500.

Activating device 502 comprises a main body 501, a top sub 501*t* and a bottom sub 501*b*. A plurality of pistons 508 comprising cutters 506 are slidably mounted in passages 510 and are retained by spline bar 512. Pistons are deployed as in the other embodiments by increasing drill fluid pressure in piston chamber 562. Nozzles 560 are in communication with piston chamber 562 to enable drilling fluid to exit the tool. The nozzles 560 are arranged to pass drilling fluid over cutters 506 to cool the cutters 506.

A ported mandrel 564 is slidably mounted in the body and is arranged to slide longitudinally along axis X between an activated position (FIG. 40) and a deactivated position (FIG. 39). The ported mandrel can be arranged to be moved in response to increased differential pressure, a surface launched ball, or weight as will be apparent to persons skilled in the art. Mandrel 564 comprises a plurality of ports 566. In the activated position, ports 566 align with piston chamber 562 to enable drill fluid to enter chamber 562 and urge pistons 508 outwardly. A latch member 536 is provided to retain the mandrel 564 in the deactivated position until it is required to be moved.

Ports 566 are dimensioned to screen debris present in drill fluid. This means that ports 566 a dimensioned to prevent debris, such as pebbles larger than a predetermined size entering piston chamber 562. If debris enters the piston chamber it can damage pistons 508, force pistons 508 outwardly and block nozzles 560.

The extent of movement of the mandrel into the activated position is limited by abutment of a first mandrel shoulder 568 against top sub shoulder 570. A flanged portion of the mandrel, formed by retaining nut 572, is used as a safety mechanism should the tool 502 break up when in use. Passages 510 form weak points, and if the tool 502 breaks up it is likely to happen here. Consequently, retaining nut 572 is arranged to abut bottom sub shoulder 574 to enable the mandrel to be used to pull the body pieces out of a borehole.

It will be appreciated by persons skilled in the art that the above embodiments have been described by way of example only and not in any limitative sense, and that various alterations and modifications are possible without departure from the scope of the invention as defined by the appended claims. In particular, the features of one or more of the embodiments described may be used in combination with any of the other embodiments.

The invention claimed is:

1. An activating device for a downhole tool, the activating device comprising:

a body having at least two pistons slidably mounted in the body for movement between an inward deactivated position and an outwardly deployed activated position, wherein said pistons each comprise an aperture formed therein extending from one lateral surface of said piston to an opposite lateral surface;

activating means for delivering a supply of fluid under pressure in order to urge said pistons outwardly into the deployed activated position; and at least one retainer removably mountable in the body to project through said aperture in both the inward deactivated position and outwardly deployed activated position to prevent removal of the corresponding piston from the body and resist rotation of the piston relative to the body.

2. A device according to claim 1, further comprising a plurality of retainers removably mountable in the body, each said retainer having a different height and wherein each said retainer projects through an aperture in a corresponding piston to enable each said piston to be outwardly deployed from the body to a different extent.

3. A device according to claim 1, wherein at least one said retainer comprises at least one cam surface for engaging a base of the aperture of at least one said piston to retain the piston in the inward deactivated position, and wherein at least one said retainer is slidable relative to the body into a position in which at least one said cam surface does not engage the base of said aperture to enable at least one said piston to move into the outwardly deployed activated position.

4. A device according to claim 1, further comprising biasing means arranged to bias at least one said piston into the inward deactivated position.

5. A device according to claim 4, wherein said biasing means comprises a leaf spring engageable with a base of the aperture of at least one said piston to bias said piston into the inward deactivated position.

6. A device according to claim 1, further comprising a plurality of pistons slidably mounted in the body, wherein each said piston is disposed at a different position along a longitudinal axis of the body such that inner ends of the pistons do not overlap.

7. A device according to claim 1, further comprising at least one protective sleeve disposed between at least one respective piston and the body.

8. A device according to claim 7, wherein one of the sleeve and body comprises a shoulder arranged to abut a recess formed on the other of the respective body and sleeve to retain the sleeve in the body.

9. A downhole tool comprising:

a drill bit;

an activating device according to claim 1; and a cutter element mounted to each said piston of the activating device.

10. A method of enlarging a hole, the method comprising obtaining a downhole tool according to claim 9 and operating said downhole tool to enlarge a hole.

11. An activating device for a downhole tool, the activating device comprising:

a body having at least one piston slidably mounted in the body for movement between an inward deactivated position and an outwardly deployed activated position, wherein at least one said piston comprises an aperture formed therein;

activating means for delivering a supply of fluid under pressure in order to urge at least one said piston outwardly into the deployed activated position; and at least one retainer removably mountable in the body to project through said aperture in both the inward deactivated position and outwardly deployed activated position to prevent removal of the corresponding piston from the body and resist rotation of the piston relative to the body, wherein at least one said retainer comprises a spline bar slidably mountable in a keyway formed in the body.

12. A device according to claim 11, wherein said keyway has a substantially T-shaped cross section and at least one said spline bar comprises a corresponding T-shape.

13. An activating device for a downhole tool, the activating device comprising:

a body having at least one piston slidably mounted in the body for movement between an inward deactivated position and an outwardly deployed activated position, wherein at least one said piston comprises an aperture formed therein;

activating means for delivering a supply of fluid under pressure in order to urge at least one said piston outwardly into the deployed activated position;

at least one retainer removably mountable in the body to project through said aperture in both the inward deactivated position and outwardly deployed activated position to prevent removal of the corresponding piston from the body and resist rotation of the piston relative to the body; and at least one screw connecting at least one said retainer to at least one said piston, wherein the screw holds at least one said piston in the inward deactivated position and the screw is adapted to break on delivery of a supply of fluid under pressure to enable at least one said piston to move outwardly into the deployed activated position.

14. A device according to claim 13, wherein at least one said piston comprises a slot disposed adjacent the aperture, and wherein a plate is slidably mountable in said aperture, the plate adapted to receive at least one said screw to enable at least one said retainer to be connected to at least one said piston.

15. A device according to claim 13, wherein at least one said screw is aligned with a radius of the tool.

16. An activating device for a downhole tool, the activating device comprising:

a body having at least one piston slidably mounted in the body for movement between an inward deactivated position and an outwardly deployed activated position, wherein at least one said piston comprises an aperture formed therein;

activating means for delivering a supply of fluid under pressure in order to urge at least one said piston outwardly into the deployed activated position, wherein the activating means for delivering a supply of fluid under pressure in order to urge at least one said piston outwardly into the deployed activated position comprises a ported mandrel arranged to move along a longitudinal axis of the tool in response to an increase in fluid pressure, such that alignment of at least one port disposed on the mandrel with a piston chamber enables fluid to flow into a piston chamber and urge at least one said piston in to the outwardly deployed activated position; and at least one retainer removably mountable in the body to project through said aperture in both the inward deactivated position and outwardly deployed activated position to prevent removal of the corresponding piston from the body and resist rotation of the piston relative to the body.

17. A device according to claim 16, wherein said ported mandrel further comprises a flanged portion arranged at an end of the mandrel, the flanged portion arranged to abut a retaining shoulder formed on the body.

18. A device according to claim 17, wherein said flanged portion is formed by at least one retaining nut disposed on the ported mandrel.

19. A device according to claim 17, wherein the body comprises a main body portion, a top sub and a bottom sub, wherein said retaining portion is formed on the bottom sub.

* * * * *